US009880493B2

(12) United States Patent
Mochizuki et al.

(10) Patent No.: US 9,880,493 B2
(45) Date of Patent: Jan. 30, 2018

(54) IMAGE FORMING APPARATUS FOR FORMING IMAGE USING DEVELOPER, METHOD FOR RELEASING REGULATION ON ATTACHMENT/DETACHMENT OF DEVELOPER STORAGE PORTIONS

(71) Applicant: KYOCERA Document Solutions Inc., Osaka-shi, Osaka (JP)

(72) Inventors: Masayuki Mochizuki, Osaka (JP); Tsuyoshi Terada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/496,978

(22) Filed: Apr. 25, 2017

(65) Prior Publication Data

US 2017/0315470 A1 Nov. 2, 2017

(30) Foreign Application Priority Data

Apr. 27, 2016 (JP) ..... 2016-089875

(51) Int. Cl.

*G03G 15/08* (2006.01)
*G03G 15/00* (2006.01)
*G03G 21/16* (2006.01)

(52) U.S. Cl.

CPC ..... *G03G 15/0831* (2013.01); *G03G 15/0832* (2013.01); *G03G 15/0856* (2013.01); *G03G 15/0865* (2013.01); *G03G 15/0896* (2013.01); *G03G 15/556* (2013.01); *G03G 21/1638* (2013.01); *G03G 2215/00548* (2013.01)

(58) Field of Classification Search

CPC ..... G03G 15/0831; G03G 15/0832; G03G 15/0856; G03G 15/0865; G03G 15/0896; G03G 15/556; G03G 21/1638; G03G 2215/00548

See application file for complete search history.

(56) References Cited

U.S. PATENT DOCUMENTS

| | | | | |
|---|---|---|---|---|
| 5,508,795 | A | 4/1996 | Kikuchi | |
| 5,640,644 | A * | 6/1997 | Kimura | G03G 15/0126 399/224 |
| 9,213,303 | B2 * | 12/2015 | Maul | G03G 21/1647 |
| 2010/0021186 | A1 * | 1/2010 | Okano | G03G 15/0194 399/21 |
| 2011/0058825 | A1 * | 3/2011 | Tsukijima | G03G 21/1633 399/27 |

FOREIGN PATENT DOCUMENTS

JP 6258941 A 9/1994

* cited by examiner

*Primary Examiner* — Rodney Bonnette
(74) *Attorney, Agent, or Firm* — Alleman Hall Creasman & Tuttle LLP

(57) ABSTRACT

An image forming apparatus includes lock mechanisms, a second detection processing portion, and a second release processing portion. The lock mechanisms regulate attachment and detachment of the developer storage portions attached to the attachment portions. The second detection processing portion detects whether or not any of the image forming units has an abnormality. The second release processing portion can release a regulation on attachment and detachment of two or more developer storage portions corresponding to two or more image forming units that include at least an image forming unit adjacent to the image forming unit detected to have the abnormality.

7 Claims, 6 Drawing Sheets

IMAGE FORMING APPARATUS FOR FORMING IMAGE USING DEVELOPER, METHOD FOR RELEASING REGULATION ON ATTACHMENT/DETACHMENT OF DEVELOPER STORAGE PORTIONS

INCORPORATION BY REFERENCE

This application is based upon and claims the benefit of priority from the corresponding Japanese Patent Application No. 2016-089875 filed on Apr. 27, 2016, the entire contents of which are incorporated herein by reference.

BACKGROUND

The present disclosure relates to an image forming apparatus for forming an image by using developer, and a method implemented in an image forming apparatus to release a regulation on attachment/detachment of developer storage portions.

In an image forming apparatus such as a printer to form a color image, a plurality of image forming units are provided. For example, in this type of image forming apparatus, a plurality of image forming units are arranged in alignment along a direction in which a sheet is conveyed by a sheet conveying portion. The plurality of image forming units form the color image by overlaying images on the sheet conveyed by the sheet conveying portion. A plurality of developer storage portions are attached to the image forming apparatus, wherein the developer storage portions store developer such as toner that is supplied to the image forming units. The developer storage portions are replaced at arbitrary timings by the user. Here, there is known an image forming apparatus that includes a lock mechanism configured to regulate attachment/detachment of the developer storage portions until an out of developer in any of the developer storage portions is detected so that the remaining amount of developer in the developer storage portion at the time of replacement is reduced.

SUMMARY

An image forming apparatus according to an aspect of the present disclosure includes a sheet conveying portion, a plurality of image forming units, a plurality of attachment portions, a plurality of lock mechanisms, a first detection processing portion, a first release processing portion, a second detection processing portion, and a second release processing portion. The sheet conveying portion conveys a sheet. The plurality of image forming units are arranged in alignment along a conveyance direction in which the sheet is conveyed by the sheet conveying portion, and configured to form an image by using developer on the sheet conveyed by the sheet conveying portion. The plurality of attachment portions are provided in correspondence with the plurality of image forming units. To the attachment portions, a plurality of developer storage portions are attached. The developer storage portions store the developer to be supplied to the image forming units. The plurality of lock mechanisms are configured to regulate attachment and detachment of the developer storage portions attached to the attachment portions. The first detection processing portion is configured to detect, for each of the developer storage portions attached to the attachment portions, whether or not that developer storage portion is in a specific state in which a remaining amount of developer is smaller than a predetermined reference amount. The first release processing portion is configured to, when the first detection processing portion has detected that a developer storage portion is in the specific state, cause the lock mechanisms to release a regulation on attachment and detachment of the developer storage portion detected to be in the specific state. The second detection processing portion is configured to detect whether or not any of the image forming units has an abnormality. The second release processing portion is capable of, when the second detection processing portion has detected that an image forming unit has an abnormality, releasing a regulation by the lock mechanisms on attachment and detachment of two or more developer storage portions corresponding to two or more image forming units that include at least an image forming unit adjacent to the image forming unit detected to have the abnormality.

A method for releasing a regulation on attachment and detachment of developer storage portions, according to another aspect of the present disclosure, is implemented in an image forming apparatus that includes: a sheet conveying portion configured to convey a sheet; a plurality of image forming units arranged in alignment along a conveyance direction in which the sheet is conveyed by the sheet conveying portion, and configured to form an image by using developer on the sheet conveyed by the sheet conveying portion; a plurality of attachment portions which are provided in correspondence with the plurality of image forming units and to which a plurality of developer storage portions are attached, the developer storage portions storing the developer to be supplied to the image forming units; and a plurality of lock mechanisms configured to regulate attachment and detachment of the developer storage portions attached to the attachment portions. The method includes a first step, a second step, a third step, and a fourth step. In the first step, it is detected whether or not any of the developer storage portions attached to the attachment portions is in a specific state in which a remaining amount of developer in a developer storage portion is smaller than a predetermined reference amount. In the second step, when it has been detected in the first step that a developer storage portion is in the specific state, the lock mechanisms are caused to release a regulation on attachment and detachment of the developer storage portion detected to be in the specific state. In the third step, it is detected whether or not any of the image forming units has an abnormality. In the fourth step, when it has been detected in the third step that an image forming unit has an abnormality, a regulation may be released, the regulation having been made by the lock mechanisms on attachment and detachment of two or more developer storage portions corresponding to two or more image forming units that include at least an image forming unit adjacent to the image forming unit detected to have the abnormality.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Outlined Configuration of Image Forming Apparatus 10]

Figure 1:
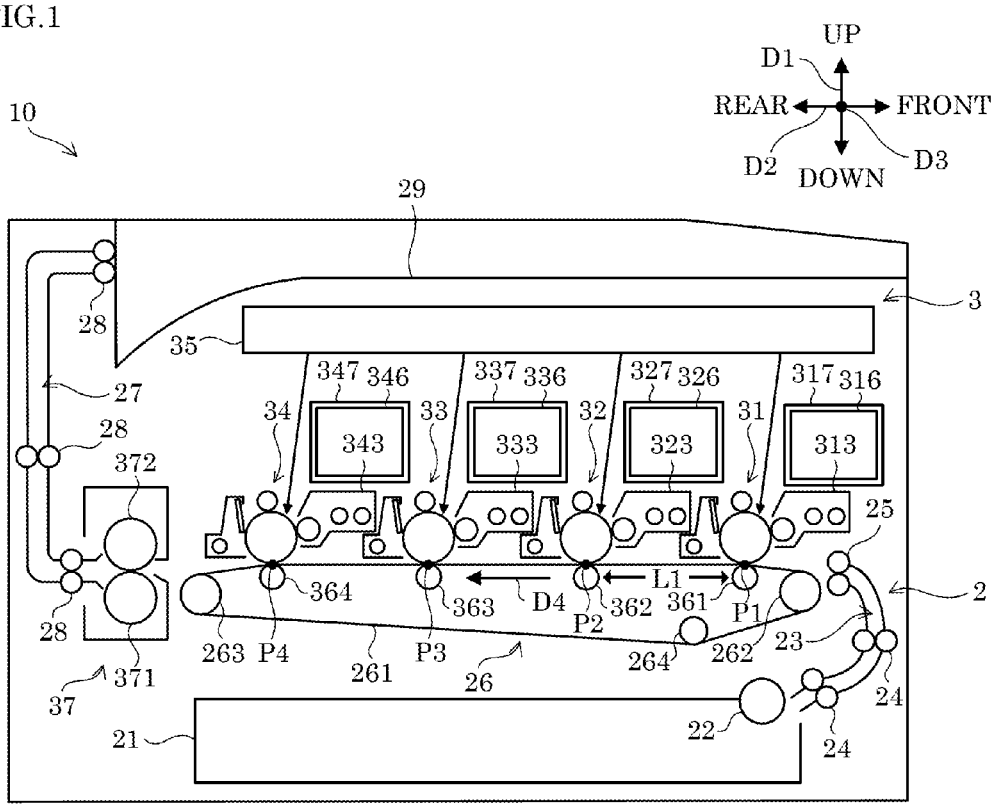
FIG. 1 is a diagram showing a configuration of an image forming apparatus according to an embodiment of the present disclosure.

First, a configuration of an image forming apparatus 10 according to an embodiment of the present disclosure is described with reference to FIG. 1 and FIG. 2. Here, FIG. 1 is a schematic cross-sectional view showing the configuration of the image forming apparatus 10. It is noted that in the following description, the up-down direction of FIG. 1 is defined as an up-down direction D1 of the image forming apparatus 10, the right-left direction of FIG. 1 is defined as a front-rear direction D2 of the image forming apparatus 10, and the depth direction of FIG. 1 is defined as a left-right direction D3 of the image forming apparatus 10.

The image forming apparatus 10 is a printer having a print function to form an image based on image data. It is noted that the present disclosure is applicable to other types of image forming apparatuses such as a facsimile device, a copier, and a multifunction peripheral.

Figure 2:
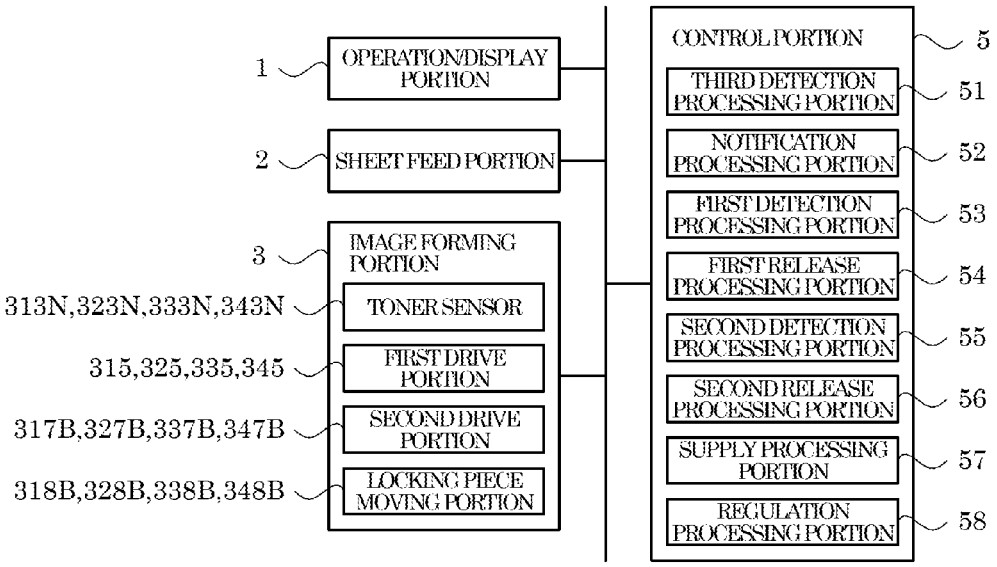
FIG. 2 is a block diagram showing a system configuration of the image forming apparatus according to the embodiment of the present disclosure.

As shown in FIG. 1 and FIG. 2, the image forming apparatus 10 includes an operation/display portion 1, a sheet feed portion 2, an image forming portion 3, and a control portion 5.

The operation/display portion 1 includes a display portion and an operation portion, wherein the display portion is, for example, a liquid crystal display and displays various types of information in response to control instructions from the control portion 5, and the operation portion is, for example, operation keys or a touch panel that inputs various types of information to the control portion 5 in response to user operations. The operation/display portion 1 is, for example, provided on an upper surface of a housing of the image forming apparatus 10.

The sheet feed portion 2 conveys a sheet on which an image is formed by the image forming portion 3. As shown in FIG. 1, the sheet feed portion 2 includes a sheet feed cassette 21, a pickup roller 22, a first conveyance path 23, a first conveyance roller 24, a registration roller 25, a sheet conveying portion (sheet conveyer) 26, a second conveyance path 27, a second conveyance roller 28, and a sheet discharge tray 29.

The sheet feed cassette 21 is loaded with sheets of various sizes. For example, the types of sheets that can be loaded on the sheet feed cassette 21 include a sheet of paper, a sheet of coated paper, a postcard, an envelope, and an OHP sheet. The pickup roller 22 feeds, one by one, the sheets stored in the sheet feed cassette 21 to the first conveyance path 23.

The first conveyance path 23 is a path along which a sheet fed from the sheet feed cassette 21 is conveyed. The first conveyance path 23 is, for example, formed by a pair of guide members provided in the housing of the image forming apparatus 10. The first conveyance path 23 connects the sheet feed cassette 21 and the sheet conveying portion 26. The first conveyance roller 24 and the registration roller 25 are provided in the first conveyance path 23. The first conveyance roller 24 conveys the sheet fed from the sheet feed cassette 21 to the registration roller 25. The registration roller 25 feeds the sheet conveyed by the first conveyance roller 24 to the sheet conveying portion 26 at a predetermined timing.

The sheet conveying portion 26 conveys the sheet fed by the registration roller 25 to a fixing device 37 via transfer positions P1 to P4 of the image forming portion 3 (see FIG. 1). The sheet conveying portion 26 includes a conveyance belt 261, a driving roller 262, a driven roller 263, and a tension roller 264. The conveyance belt 261 is an endless belt member configured to convey the sheet. As shown in FIG. 1, the driving roller 262 and the driven roller 263 are disposed in the housing of the image forming apparatus 10 so as to be separated from each other in the front-rear direction D2. The conveyance belt 261 is stretched between the driving roller 262 and the driven roller 263. The tension roller 264 applies a predetermined tension to the conveyance belt 261. In the sheet conveying portion 26, the driving roller 262 is driven to rotate by a driving force supplied from a power source (not shown) such as a motor. This allows the conveyance belt 261 to move along a conveyance direction D4 shown in FIG. 1. Accordingly, the sheet fed by the registration roller 25 and placed on the conveyance belt 261 is conveyed along the conveyance direction D4.

The second conveyance path 27 is a path along which a sheet fed from the fixing device 37 is conveyed. The second conveyance path 27 is, for example, formed by a pair of guide members provided in the housing of the image forming apparatus 10. The second conveyance path 27 connects the fixing device 37 and the sheet discharge tray 29. The second conveyance roller 28 is provided in the second conveyance path 27. The second conveyance roller 28 conveys the sheet fed from the fixing device 37 to the sheet discharge tray 29. The sheet with an image formed thereon by the image forming portion 3 is discharged to the sheet discharge tray 29.

The control portion 5 includes control equipment such as CPU, ROM, RAM, and EEPROM that are not shown. The CPU is a processor that executes various calculation processes. The ROM is a nonvolatile storage portion in which various information such as control programs for causing the CPU to execute various processes are stored in advance. The RAM is a volatile storage portion, and the EEPROM is a nonvolatile storage portion. The RAM and the EEPROM are used as temporary storage memory (working area) for the various processes executed by the CPU. In the control portion 5, the CPU executes the various control programs stored in advance in the ROM. This allows the image forming apparatus 10 to be controlled comprehensively by the control portion 5. It is noted that the control portion 5 may be formed as an electronic circuit such as an integrated circuit (ASIC), and may be a control portion provided independently of a main control portion that comprehensively controls the image forming apparatus 10.

[Configuration of Image Forming Portion 3]

Figure 3:
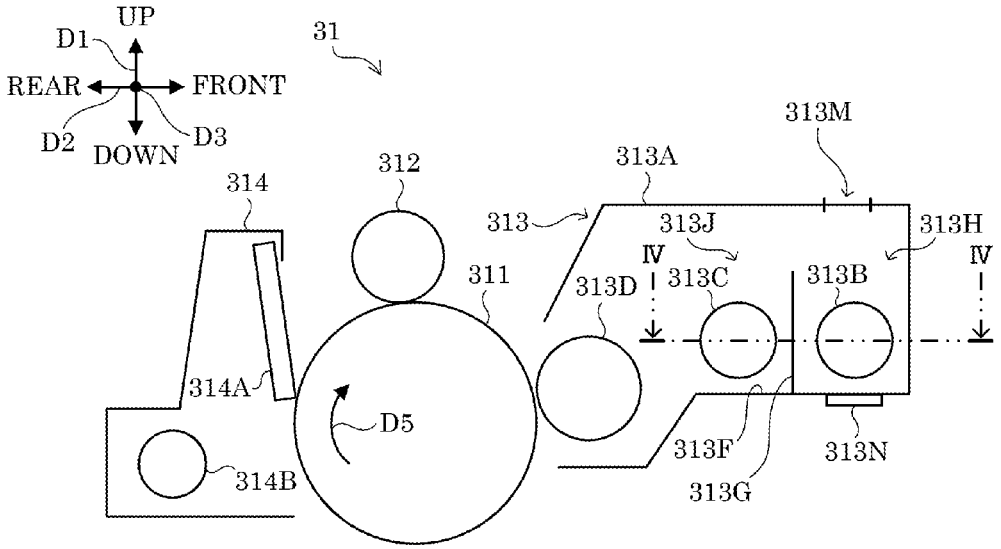
FIG. 3 is a diagram showing a configuration of an image forming unit of the image forming apparatus according to the embodiment of the present disclosure.
Figure 4:
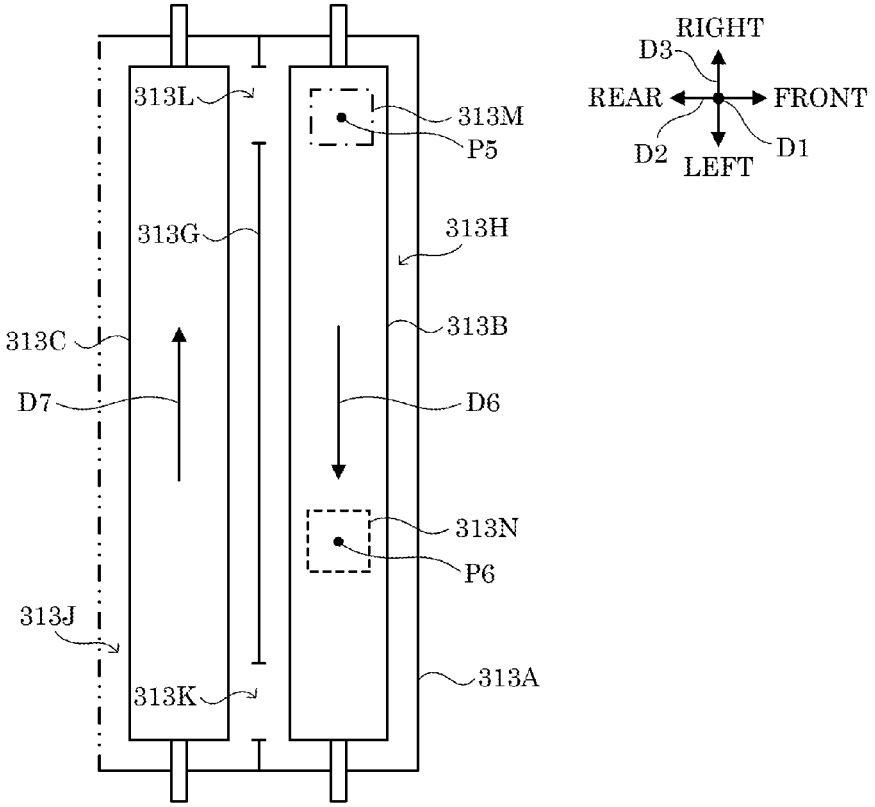
FIG. 4 is a diagram showing a configuration of a developing portion of the image forming apparatus according to the embodiment of the present disclosure.
Figure 5:
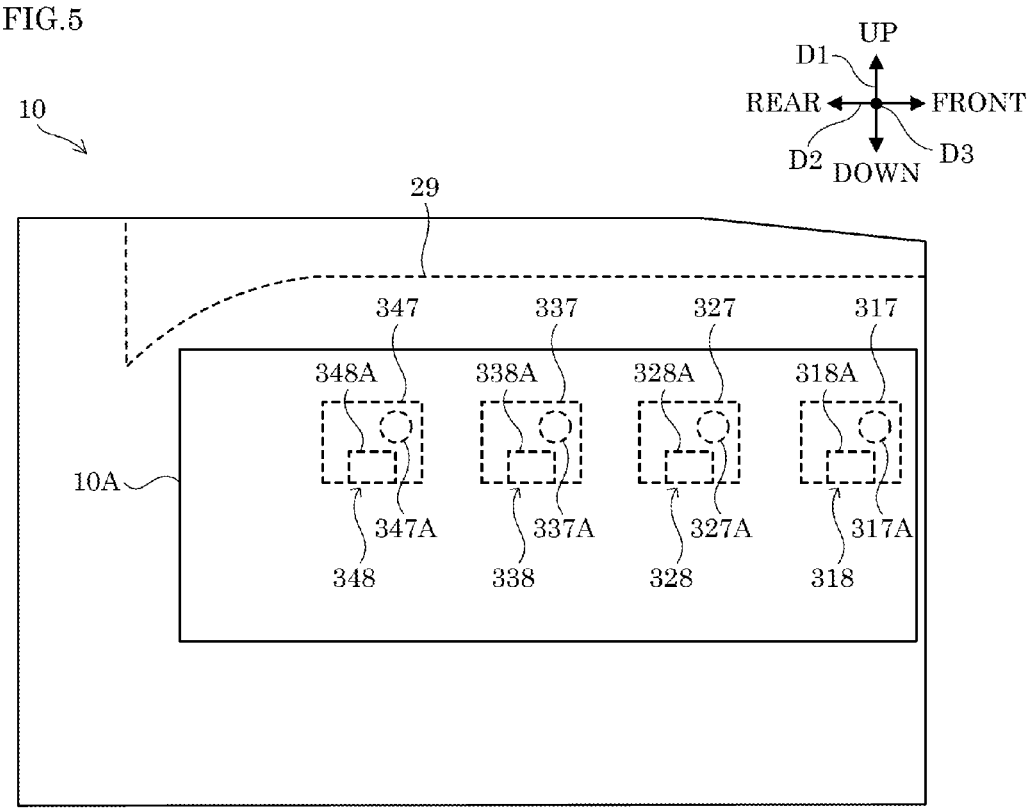
FIG. 5 is a diagram showing a configuration of attachment portions and lock mechanisms of the image forming apparatus according to the embodiment of the present disclosure.

Next, a configuration of the image forming portion 3 is described with reference to FIG. 1 to FIG. 5. Here, FIG. 3 is a schematic cross-sectional view showing a configuration of an image forming unit 31. FIG. 4 is a cross-sectional view taken along line IV-IV of FIG. 3, viewed from a direction indicated by the arrows of FIG. 3. FIG. 5 is a schematic diagram showing a configuration of the left side surface of the image forming apparatus 10. It is noted that the one-dot chain line of FIG. 4 indicates a position of an opening portion 313M in a developing portion 313. In addition, a part of the developing portion 313 is omitted in FIG. 4.

The image forming portion 3 is configured to execute an image forming process (a print process) in which to form a color or monochrome image by the electrophotography method based on image data input from an external information processing apparatus such as a personal computer.

As shown in FIG. 1, the image forming portion 3 includes a plurality of image forming units 31 to 34, a laser scanning device 35, transfer rollers 361 to 364, and the fixing device 37.

The image forming units 31, 32, 33, and 34 are electrophotographic image forming units corresponding to Y (yellow), C (cyan), M (magenta), and K (black), respectively. As shown in FIG. 1, the image forming units 31 to 34 are arranged in alignment along the conveyance direction D4 in which the sheet is conveyed by the sheet conveying portion 26, in an order of yellow, cyan, magenta, and black from the upstream side in the conveyance direction D4. For example, the image forming units 31 to 34 are arranged at regular intervals along the conveyance direction D4. Here, the image forming units 31 to 34 are an example of the plurality of image forming units of the present disclosure.

The image forming unit 31 forms an image on a sheet conveyed by the sheet conveying portion 26 by using toner (an example of the developer of the present disclosure). As shown in FIG. 3, the image forming unit 31 includes a photoconductor drum 311, a charging roller 312, a developing portion 313, and a cleaning portion 314. In addition, the image forming portion 3 includes a first drive portion 315 (see FIG. 2), such as a motor, that supplies a driving force to the photoconductor drum 311 and the developing portion 313 of the image forming unit 31. On the other hand, the image forming units 32 to 34 have the same configuration as the image forming unit 31. For example, as shown in FIG. 1, the image forming units 32, 33, and 34 respectively include developing portions 323, 333, and 343. In addition, the image forming portion 3 includes first drive portions 325, 335, and 345 that respectively supply driving forces to the photoconductor drums and the developing portions 323, 333, and 343 of the image forming units 32 to 34.

An electrostatic latent image is formed on the surface of the photoconductor drum 311. The photoconductor drum 311 is rotated along a rotation direction D5 shown in FIG. 3, by a driving force supplied from a first drive portion 315 via a power transmission mechanism (not shown). The photoconductor drum 311 is arranged so as to be in contact with the conveyance belt 261 at a transfer position P1 shown in FIG. 1.

The charging roller 312 charges the photoconductor drum 311. For example, as shown in FIG. 3, the charging roller 312 is disposed so as to be in contact with the photoconductor drum 311. A voltage is applied to the charging roller 312 from a power source device (not shown). This allows a discharge to be generated between the charging roller 312 and the photoconductor drum 311, and the surface of the photoconductor drum 311 is charged.

The developing portion 313 develops the electrostatic latent image formed on the photoconductor drum 311 by using toner (an example of the developer of the present disclosure). The developing portion 313 is driven by a driving force supplied from the first drive portion 315 via the power transmission mechanism. The developing portion 313 is described in detail below.

The cleaning portion 314 removes residual toner from the surface of the photoconductor drum 311. The cleaning portion 314, for example, includes a blade-like cleaning member 314A and a conveyance screw 314B.

The laser scanning device 35 forms the electrostatic latent image on the surface of each of the photoconductor drums respectively included in the image forming units 31 to 34.

The transfer rollers 361 to 364 transfer the toner images formed on the surfaces of the photoconductor drums of the image forming units 31 to 34, to a sheet conveyed by the sheet conveying portion 26. As shown in FIG. 1, the transfer roller 361 is disposed at a position that faces the photoconductor drum 311 of the image forming unit 31 across the conveyance belt 261. In addition, the transfer roller 362 is disposed at a position that faces the photoconductor drum of the image forming unit 32 across the conveyance belt 261. The transfer roller 363 is disposed at a position that faces the photoconductor drum of the image forming unit 33 across the conveyance belt 261. In addition, the transfer roller 364 is disposed at a position that faces the photoconductor drum of the image forming unit 34 across the conveyance belt 261. A voltage is applied to the transfer rollers 361 to 364 from a power source device (not shown). This allows electric fields to be formed between the transfer rollers 361 to 364 and the photoconductor drums of the image forming units 31 to 34, respectively, and the toner images formed on the surfaces of the photoconductor drums of the image forming units 31 to 34 are transferred to the sheet conveyed by the sheet conveying portion 26.

The fixing device 37 fuses and fixes, to the sheet, the toner images transferred to the sheet by the transfer rollers 361 to 364. The fixing device 37, for example, includes a fixing roller 371 and a pressure roller 372. The fixing roller 371 is disposed so as to be in contact with the pressure roller 372, and heats the toner images transferred to the sheet so that the toner images are fixed to the sheet. The pressure roller 372 presses the sheet while the sheet is passing through a nip portion formed between the pressure roller 372 and the fixing roller 371.

In the image forming portion 3, a color image is formed on the sheet supplied from the sheet feed portion 4 in the procedures described below, and the sheet with the color image formed thereon is discharged to the sheet discharge tray 29.

First, in the image forming unit 31, the charging roller 312 charges the photoconductor drum 311 uniformly to a certain potential. Next, the laser scanning device 35 irradiates light onto the surface of the photoconductor drum 311 based on image data. This allows an electrostatic latent image corresponding to the image data to be formed on the surface of the photoconductor drum 311. The electrostatic latent image on the surface of the photoconductor drum 311 is developed (visualized) as a toner image of yellow by the developing portion 313.

Subsequently, the yellow toner image formed on the photoconductor drum 311 is transferred to the sheet conveyed by the sheet conveying portion 26, at the transfer position P1 by the transfer roller 361. On the other hand, the residual toner on the surface of the photoconductor drum 311 is removed by the cleaning portion 314. For example, in the cleaning portion 314, the residual toner on the surface of the photoconductor drum 311 is removed by the cleaning member 314A. The toner removed by the cleaning member 314A is conveyed by the conveyance screw 314B to a toner storage container (not shown) and collected in the toner storage container.

It is noted that in the image forming units 32 to 34, too, toner images of respective colors are formed on the photoconductor drums of the image forming units 32 to 34, and the toner images are overlaid on and transferred to the sheet coveyed by the sheet conveying portion 26, in an order of yellow, cyan, magenta, and black. Thereafter, the toner images transferred to the sheet are fused and fixed to the sheet by the fixing device 37 so that an image is formed on the sheet, and the sheet is discharged to the sheet discharge tray 29.

Next, the developing portion 313 is described in detail. It is noted that the developing portions 323, 333, and 343 have the same configuration as the developing portion 313 described below.

As shown in FIG. 3 and FIG. 4, the developing portion 313 includes a housing 313A, a first conveyance member 313B, a second conveyance member 313C, a developing roller 313D, and a toner sensor 313N.

As shown in FIG. 3, the housing 313A stores the first conveyance member 313B, the second conveyance member 313C, and the developing roller 313D. In addition, the housing 313A stores the toner. Specifically, the housing 313A stores the toner in an inner space that is formed by side walls and a bottom surface 313F.

As shown in FIG. 4, the housing 313A includes a first conveyance path 313H and a second conveyance path 313J along which the toner is conveyed. Specifically, as shown in FIG. 3 and FIG. 4, a partition wall 313G is formed on the bottom surface 313F of the housing 313A. The side walls of the housing 313A, the bottom surface 313F, and the partition wall 313G form the first conveyance path 313H along which the toner is conveyed into the housing 313A. In addition, the side walls of the housing 313A, the bottom surface 313F, and the partition wall 313G form the second conveyance path 313J along which the toner is conveyed into the housing 313A.

As shown in FIG. 4, the first conveyance member 313B is provided in the first conveyance path 313H. In the first conveyance path 313H, the first conveyance member 313B conveys the toner in a conveyance direction D6 shown in FIG. 4 (leftward in the left-right direction D3), and electrically charges the toner. Specifically, the first conveyance member 313B, during the conveyance of the toner, stirs and charges the toner. The first conveyance member 313B is a stirring screw, for example. The first conveyance member 313B is, for example, rotationally driven by a driving force supplied from the first drive portion 315 via the power transmission mechanism.

As shown in FIG. 4, the second conveyance member 313C is provided in the second conveyance path 313J. In the second conveyance path 313J, the second conveyance member 313C conveys the toner in a conveyance direction D7 shown in FIG. 4 (rightward in the left-right direction D3), and electrically charges the toner. Specifically, the second conveyance member 313C, during the conveyance of the toner, stirs and charges the toner. The second conveyance member 313C is a stirring screw, for example. As is the case with the first conveyance member 313B, the second conveyance member 313C is, for example, rotationally driven by a driving force supplied from the first drive portion 315 via the power transmission mechanism.

A first connection portion 313K that connects the first conveyance path 313H with the second conveyance path 313J, is provided in the partition wall 313G at a position on the downstream side in the conveyance direction D6. On the other hand, a second connection portion 313L that connects the first conveyance path 313H with the second conveyance path 313J, is provided in the partition wall 313G at a position on the downstream side in the conveyance direction D7. With this configuration, the toner stored in the housing 313A is conveyed by the first conveyance member 313B and the second conveyance member 313C in such a way as to circulate through the first conveyance path 313H and the second conveyance path 313J.

The developing roller 313D develops the electrostatic latent image formed on the surface of the photoconductor drum 311, by using the toner conveyed along the second conveyance path 313J by the second conveyance member 313C. For example, the developing roller 313D, as is the case with the first conveyance member 313B and the second conveyance member 313C, is rotationally driven by a driving force supplied from the first drive portion 315 via the power transmission mechanism.

It is noted that the developing method of the developing portion 313 is not limited to the above-described one-component developing method that uses toner. For example, the developing method of the developing portion 313 may be a two-component developing method that uses toner and carrier.

The opening portion 313M is provided in the first conveyance path 313H at a position on the upstream side in the conveyance direction D6. As shown in FIG. 3, for example, the opening portion 313M is provided in an upper surface of the housing 313A in a portion above the first conveyance path 313H. The opening portion 313M is used to supply the toner supplied from a toner container 316 that is described below, into the first conveyance path 313H. Specifically, the toner supplied from the toner container 316 passes through the opening portion 313M and is supplied into the first conveyance path 313H at a conveyance position P5 (see FIG. 4).

The toner sensor 313N is configured to detect an amount of toner at a detection position P6 (see FIG. 4) that is more on the downstream side in the conveyance direction D6 than the opening portion 313M in the first conveyance path 313H. The toner sensor 313N is, for example, provided on a bottom of the housing 313A, as shown in FIG. 3. The toner sensor 313N is, for example, a permeability sensor including an LC oscillator that outputs an electric signal corresponding to a permeability of the toner stored in the housing 313A.

For example, in the image forming apparatus 10, a remaining amount of toner in the developing portion 313 is obtained by integrating the values detected by the toner sensor 313N during a detection period that is longer than the time required for the first conveyance member 313B to convey the toner from the conveyance position P5 to the detection position P6. For example, the detection period equals to a time period required for the toner to circulate the developing portion 313 once. It is noted that the detection period may be longer or shorter than the time period required for the toner to circulate the developing portion 313 once.

As shown in FIG. 1, toner containers 316, 326, 336, and 346 are attached to the image forming portion 3. The toner container 316 stores yellow toner that is supplied to the image forming unit 31. The toner container 326 stores cyan toner that is supplied to the image forming unit 32. The toner container 336 stores magenta toner that is supplied to the image forming unit 33. The toner container 346 stores black toner that is supplied to the image forming unit 34. It is noted that the toner containers 316, 326, 336, and 346 have the same configuration, except that colors of the toner stored therein are different. Accordingly, in the following, only the toner container 316 is described.

The toner container 316 is, for example, an elongated, substantially square cylindrical container extending along the left-right direction D3. The toner container 316 includes a conveyance member (not shown) that conveys the toner inside the toner container 316.

In addition, as shown in FIG. 1 and FIG. 5, the image forming portion 3 further includes attachment portions 317, 327, 337, and 347, and lock mechanisms 318, 328, 338, and 348. The attachment portions 317, 327, 337, and 347 respectively correspond to the image forming units 31, 32, 33, and 34. It is noted that the attachment portions 317, 327, 337, and 347 have the same configuration, except that the toner containers attached thereto are different. In addition, the lock mechanisms 318, 328, 338, and 348 have the same configuration, except that the toner containers whose attachment and detachment are regulated by them are different. Accordingly, in the following, only the attachment portion 317 and the lock mechanism 318 are described.

The toner container 316 is attached to the attachment portion 317. The attachment portion 317 is, for example, provided in an upper portion of the image forming portion 3 so as to be elongated along the left-right direction D3, as shown in FIG. 1 and FIG. 5. The attachment portion 317 is covered with a housing cover 10A, as shown in FIG. 5. Here, the toner container 316 is an example of the developer storage portion of the present disclosure. In addition, the attachment portions 317, 327, 337, and 347 are an example of the plurality of attachment portions of the present disclosure.

The housing cover 10A is a cover member provided on an outer side of the image forming apparatus 10 in such a way as to be opened and closed. Specifically, as shown in FIG. 5, the housing cover 10A is provided on the left side surface of the image forming apparatus 10 in correspondence with arrangement positions of the attachment portions 317, 327, 337, and 347. The housing cover 10A is opened and closed, for example, by a hinge provided at one of opposite end portions thereof in the front-rear direction D2. It is noted that an open/close detection switch (not shown) is provided at an end portion of the housing cover 10A that is opposite to the end portion having the hinge, the open/close detection switch being configured to detect whether the housing cover 10A is opened or closed. The open/close detection switch inputs, to the control portion 5, an electric signal corresponding to the opened or closed state of the housing cover 10A.

The housing cover 10A is opened by the user when any of the toner containers 316, 326, 336, and 346 is attached or detached. When the housing cover 10A is opened, the attachment portions 317, 327, 337, and 347 are exposed to outside. This enables the user to insert or pull out an attachment/detachment target toner container along the left-right direction D3.

In addition, the housing cover 10A is opened by the user when any of the image forming units 31 to 34 is removed. For example, the image forming units 31 to 34 are supported by the housing of the image forming apparatus 10 in such a way as to slide along the left-right direction D3 in the image forming apparatus 10. As a result, the user can remove a removal-target image forming unit by opening the housing cover 10A and pulling out the image forming unit along the left-right direction D3.

Here, in the image forming apparatus 10, the image forming unit 31 is regulated from sliding along the left-right direction D3 by the toner container 316 attached to the attachment portion 317. In the image forming apparatus 10, for example, a projection portion (not shown) projecting upward is provided at the right end portion of the image forming unit 31 in the left-right direction D3. When the image forming unit 31 is slid along the left-right direction D3, the projection portion thereof comes into contact with the right end portion of the toner container 316 attached to the attachment portion 317. This regulates the image forming unit 31 from sliding along the left-right direction D3. That is, in the image forming apparatus 10, the image forming unit 31 cannot be removed unless the toner container 316 is removed.

It is noted that the housing cover 10A may be provided on an upper surface of the image forming apparatus 10. Specifically, the housing cover 10A may be a part of the sheet discharge tray 29. In that case, in the image forming apparatus 10, the toner containers 316, 326, 336, and 346 and the image forming units 31 to 34 may be provided so as to be inserted and pulled out along the up-down direction D1.

As shown in FIG. 5, a connection portion 317A is provided in the right end portion of the attachment portion 317 in the left-right direction D3. The connection portion 317A is engaged with the conveyance member which is included in the toner container 316 attached to the attachment portion 317. The connection portion 317A is, for example, a gear. In addition, the image forming portion 3 includes a second drive portion 317B (see FIG. 2) that is, for example, a motor and supplies a driving force to the conveyance member of the toner container 316 attached to the attachment portion 317 via the connection portion 317A. When the conveyance member is driven by the driving force that is supplied from the second drive portion 317B via the connection portion 317A, the toner is supplied from the toner container 316 to the image forming unit 31.

The lock mechanism 318 regulates attachment/detachment of the toner container 316 attached to the attachment portion 317. The lock mechanism 318, for example, includes a locking piece 318A and a locking piece moving portion 318B, as shown in FIG. 2 and FIG. 5. The locking piece 318A is provided in the left end portion of the attachment portion 317 in the left-right direction D3, as shown in FIG. 5. The locking piece 318A is provided, for example, in such a way as to move along the up-down direction D1 between a closing position for closing and an opening position for opening the left end portion of the attachment portion 317. The locking piece moving portion 318B moves the locking piece 318A between the closing position and the opening position. The locking piece moving portion 318B is, for example, a solenoid. In the lock mechanism 318, for example, the locking piece 318A is held at either the closing position or the opening position depending on whether power is supplied from a power source portion (not shown) to the locking piece moving portion 318B. Here, the lock mechanisms 318, 328, 338, and 348 are an example of the plurality of lock mechanisms of the present disclosure.

In the image forming apparatus 10, when a first state (out of toner) in which the remaining amount of toner in the toner container 316 is less than a predetermined first reference amount, is detected, the regulation on attachment/detachment of the toner container 316 by the lock mechanism 318 is released. Here, the first reference amount is an example of the reference amount of the present disclosure. In addition, the first state is an example of the specific state of the present disclosure.

In the image forming apparatus 10, after the toner container 316 is replaced following the detection of the first state, a supply process is executed to cause the toner container 316 to supply toner to the developing portion 313 until the remaining amount of toner in the developing portion 313 detected by the toner sensor 313N exceeds a predetermined threshold.

Meanwhile, in the image forming apparatus 10, a paper jam may occur in which one or more sheets conveyed by the sheet conveying portion 26 are jammed. In addition, in the image forming apparatus 10, when a paper jam occurs, an abnormality may be detected such as an overcurrent abnormality in which an excessive current flows in any of the first drive portions 315, 325, 335, and 345 that respectively drive the image forming units 31, 32, 33, and 34. For example, an overcurrent abnormality may be detected when a sheet conveyed by the sheet conveying portion 26 comes into contact with the power transmission mechanism and causes a paper jam. Here, in a case where a setting is made such that the attachment/detachment regulation of only a toner container corresponding to an image forming unit detected to have an abnormality is released, if a sheet that caused the paper jam is in contact with a plurality of image forming units, the sheet cannot be removed. On the other hand, in the image forming apparatus 10 according to the embodiment of the present disclosure, as described below, it is possible to reduce the remaining amount of toner in the toner containers 316, 326, 336, and 346 at the time of replacement, and remove the sheet that caused the paper jam in the apparatus.

Specifically, an attachment/detachment regulation control program is stored in the ROM of the control portion 5 in advance, wherein the attachment/detachment regulation control program causes the CPU to excute an abnormality detection process (see the flowchart of FIG. 6), a first regulation control process (see the flowchart of FIG. 7), and a second regulation control process (see the flowchart of FIG. 8) that are described below. It is noted that the attachment/detachment regulation control program may be recorded on a computer-readable recording medium such as a CD, a DVD, or a flash memory, and read from the recording medium and installed into a storage portion, such as the EEPROM, of the control portion 5.

As shown in FIG. 2, the control portion 5 includes a third detection processing portion 51, a notification processing portion 52, a first detection processing portion 53, a first release processing portion 54, a second detection processing portion 55, a second release processing portion 56, a supply processing portion 57, and a regulation processing portion 58. Specifically, the control portion 5 executes the attachment/detachment regulation control program stored in the ROM by using the CPU. This allows the control portion 5 to function as the third detection processing portion 51, the notification processing portion 52, the first detection processing portion 53, the first release processing portion 54, the second detection processing portion 55, the second release processing portion 56, the supply processing portion 57, and the regulation processing portion 58.

The third detection processing portion 51 is configured to detect whether or not any of the toner containers attached to the attachment portions 317, 327, 337, and 347 is in a second state in which the remaining amount of toner in the toner container is equal to or larger than the first reference amount and smaller than a predetermined second reference amount that is larger than the first reference amount.

For example, the third detection processing portion 51 detects whether or not the toner container 316 is in the second state based on the remaining amount of toner in the developing portion 313 detected by the toner sensor 313N. For example, the third detection processing portion 51 detects the second state based on an increase rate of the remaining amount of toner in the developing portion 313 detected by the toner sensor 313N when the toner is supplied from the toner container 316 to the developing portion 313 during the print process.

It is noted that the third detection processing portion 51 may detect the second state by calculating a toner consumption amount based on a printing rate of image data printed in the print process, and comparing a cumulative value of the calculated toner consumption amount with an amount of toner stored in the toner container 316. In addition, the third detection processing portion 51 may detect the second state by calculating an amount of toner conveyed from the toner container 316 based on a time period for which the conveyance member is driven by the second drive portion 317B, and comparing a cumulative value of the calculated toner conveyance amount with the amount of toner stored in the toner container 316.

For example, in the image forming apparatus 10, state information is stored in a predetermined storage area in the EEPROM, wherein the state information indicates the state of each of the toner containers 316, 326, 336, and 346. For example, the third detection processing portion 51, when having detected that a toner container is in the second state, rewrites a piece of state information corresponding to the toner container detected to be in the second state, so as to indicate the second state, whereas up to that point, the piece of state information has indicated a third state in which the remaining amount of toner stored in the toner container is equal to or larger than the second reference amount.

When the third detection processing portion 51 has detected that a toner container is in the second state, the notification processing portion 52 notifies about the toner container detected to be in the second state.

The first detection processing portion 53 is configured to detect whether or not any of the toner containers attached to the attachment portions 317, 327, 337, and 347 is in a first state in which the remaining amount of toner in the toner container is smaller than the first reference amount.

For example, as is the case with the third detection processing portion 51, the first detection processing portion 53 detects whether or not the toner container 316 is in the first state based on the remaining amount of toner in the developing portion 313 detected by the toner sensor 313N. For example, the first detection processing portion 53 detects whether or not the toner container 316 is in the first state based on the increase rate of the remaining amount of toner in the developing portion 313 detected by the toner sensor 313N when the toner is supplied from the toner container 316 to the developing portion 313 during the print process.

It is noted that the first detection processing portion 53 may detect the first state by calculating a toner consumption amount based on a printing rate of image data printed in the print process, and comparing a cumulative value of the calculated toner consumption amount with an amount of toner stored in the toner container 316. In addition, the first detection processing portion 53 may detect whether or not any toner container is in the first state by calculating an amount of toner conveyed from the toner container 316 based on a time period for which the conveyance member is driven by the second drive portion 317B, and comparing a cumulative value of the calculated toner conveyance amount with the amount of toner stored in the toner container 316.

For example, upon detecting that a toner container is in the first state, the first detection processing portion 53 rewrites a piece of state information corresponding to the toner container detected to be in the first state, so as to indicate the first state, whereas up to that point, the piece of state information has indicated the second state.

The first release processing portion 54, when the first detection processing portion 53 has detected that a toner container is in the first state, causes the lock mechanisms 318, 328, 338, and 348 to release the regulation on attachment/detachment of the toner container detected to be in the first state.

For example, when the first detection processing portion 53 has detected that the toner container 316 is in the first state, the first release processing portion 54 causes the power source portion to supply power to the locking piece moving portion 318B. With this execution, in the lock mechanism 318, the locking piece 318A is moved from the closing position to the opening position, and is held in the opening position.

The second detection processing portion 55 is configured to detect whether or not any of the image forming units 31 to 34 has an abnormality.

For example, abnormalities that may be detected in the image forming unit 31 include an overcurrent abnormality in which a current supplied to the first drive portion 315 or the second drive portion 317B exceeds a predetermined allowable value. Here, the first drive portions 315, 325, 335, and 345 and the second drive portions 317B, 327B, 337B, and 347B are an example of the plurality of drive portions of the present disclosure.

In addition, abnormalities that may be detected in the image forming unit 31 include a driving abnormality in which the first drive portion 315 or the second drive portion 317B cannot be driven. Furthermore, abnormalities that may be detected in the image forming unit 31 include an access abnormality in which the control portion 5 cannot access the EEPROM (not shown) provided in the image forming unit 31.

When the second detection processing portion 55 has detected that an image forming unit has an abnormality, the second release processing portion 56 may release the regulation by the lock mechanisms on attachment/detachment of two or more toner containers corresponding to two or more image forming units that include at least an image forming unit(s) adjacent to the image forming unit detected to have the abnormality.

Specifically, in a case where the abnormality detected by the second detection processing portion 55 is an overcurrent abnormality, the second release processing portion 56 releases the regulation by the lock mechanisms on attachment/detachment of two or more toner containers corresponding to two or more image forming units that include at least an image forming unit(s) adjacent to the image forming unit detected to have the overcurrent abnormality.

For example, when the second detection processing portion 55 has detected that the image forming unit 31 has an overcurrent abnormality, the second release processing portion 56 releases the regulation by the lock mechanism 318 on attachment/detachment of the toner container 316, and releases the regulation by the lock mechanism 328 on attachment/detachment of the toner container 326 that corresponds to the image forming unit 32 adjacent to the image forming unit 31.

In addition, when the second detection processing portion 55 has detected that the image forming unit 32 has an overcurrent abnormality, the second release processing portion 56 releases the regulation by the lock mechanism 328 on attachment/detachment of the toner container 326, and releases the regulation by the lock mechanisms 318 and 338 on attachment/detachment of the toner containers 316 and 336 that correspond to the image forming units 31 and 33 adjacent to the image forming unit 32.

It is noted that when the second detection processing portion 55 has detected that an image forming unit has an overcurrent abnormality, the second release processing portion 56 may release the regulation by the lock mechanisms on attachment/detachment of all the toner containers.

Here, in a case where the abnormality detected by the second detection processing portion 55 is an overcurrent abnormality, and the length in the conveyance direction D4 of the sheet conveyed by the sheet conveying portion 26 is smaller than a predetermined specific distance that is equal to or larger than an interval between the image forming units 31 to 34, the second release processing portion 56 does not release the regulation by the lock mechanisms on attachment/detachment of the toner containers corresponding to the image forming units other than the image forming unit detected to have the overcurrent abnormality. The specific distance is, for example, a distance L1 (see FIG. 1) between the transfer positions P1 and P2. The distance L1 is, for example, smaller than the length in the conveyance direction D4 of an A4 size sheet conveyed by the sheet conveying portion 26.

On the other hand, in a case where the abnormality detected by the second detection processing portion 55 is one of the above-mentioned three types of abnormalities and is not the overcurrent abnormality, the second release processing portion 56 does not release the regulation by the lock mechanisms on attachment/detachment of the toner containers corresponding to the plurality of image forming units.

For example, when the second detection processing portion 55 has detected that the image forming unit 31 has a driving abnormality, the second release processing portion 56 releases only the regulation by the lock mechanism 318 on attachment/detachment of the toner container 316. In addition, when the second detection processing portion 55 that the image forming unit 31 has an access abnormality, the second release processing portion 56 does not release the regulation by the lock mechanisms on attachment/detachment of any of the toner containers.

It is noted that, even in a case where the abnormality detected by the second detection processing portion 55 is other than the overcurrent abnormality, the second release processing portion 56 may release the regulation by the lock mechanisms on attachment/detachment of the plurality of toner containers corresponding to the plurality of image forming units that include at least an image forming unit(s) adjacent to the image forming unit detected to have the abnormality.

When a regulation by a lock mechanism has been released on attachment/detachment of a toner container corresponding to an image forming unit other than the image forming unit detected to have the abnormality, the notification processing portion 52 notifies about the toner container whose regulation on attachment/detachment has been released.

The supply processing portion 57, upon determining that a toner container whose regulation on attachment/detachment had been released by the first release processing portion 54 was replaced with a new toner container, executes the supply process in which to cause the new toner container to supply toner to a corresponding developing portion until the remaining amount of toner in the developing portion detected by a toner sensor exceeds the threshold.

For example, when the open/close detection switch detects opening and then closing of the housing cover 10A in a state where the regulation on attachment/detachment of a toner container had been released by the first release processing portion 54, the supply processing portion 57 determines that the toner container whose regulation on attachment/detachment had been released was replaced with a new toner container. It is noted that when a predetermined operation is performed on the operation/display portion 1 in a state where the regulation on attachment/detachment of a toner container had been released by the first release processing portion 54, the supply processing portion 57 may determine that the toner container whose regulation on attachment/detachment had been released was replaced with a new toner container.

For example, upon determining that the toner container 316 was replaced with a new toner container in a state where the regulation on attachment/detachment of the toner container 316 had been released by the first release processing portion 54, the supply processing portion 57 executes the supply process to cause the new toner container 316 to supply toner to the developing portion 313 until the remaining amount of toner in the developing portion 313 detected by the toner sensor 313N exceeds the threshold. Specifically, the supply processing portion 57 drives the conveyance member of the toner container 316 by controlling the second drive portion 317B.

When the supply process for a toner container is completed, the supply processing portion 57 rewrites a piece of state information corresponding to the toner container for which the supply process is completed, so as to indicate the third state, whereas up to that point, the piece of state information has indicated the first state.

The regulation processing portion 58 causes the lock mechanisms 318, 328, 338, and 348 to regulate the toner container for which the supply process has been completed, from being attached to and detached from a corresponding attachment portion.

The regulation processing portion 58, upon determining that the abnormality detected by the second detection processing portion 55 has been eliminated, causes the lock mechanisms to regulate the attachment/detachment of the toner container(s) whose regulation on attachment/detachment has been released by the second release processing portion 56.

For example, the regulation processing portion 58 causes the power source portion to stop supplying power to the locking piece moving portion 318B. With this execution, in the lock mechanism 318, the locking piece 318A is moved from the opening position to the closing position, and is held at the closing position.

[Abnormality Detection Process]

Figure 6:
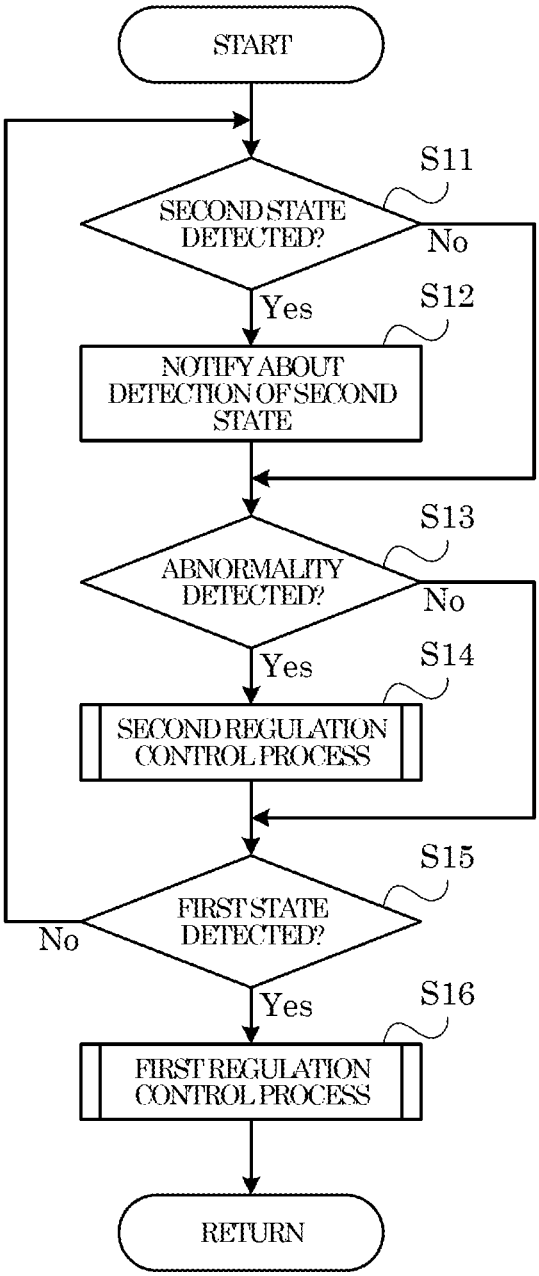
FIG. 6 is a flowchart showing an example of an abnormality detection process executed by the image forming apparatus according to the embodiment of the present disclosure.

In the following, with reference to FIG. 6, a description is given of an example of the procedure of the abnormality detection process executed by the control portion 5 in the image forming apparatus 10. Here, steps S11, S12, . . . represent numbers assigned to the processing procedures (steps) executed by the control portion 5.

<Step S11>

First, in step S11, the control portion 5 detects whether or not any of the toner containers attached to the attachment portions 317, 327, 337, and 347 is in the second state, wherein in the second state, the remaining amount of toner in the toner container is equal to or larger than the first reference amount and smaller than the second reference amount. Here, the process of step S11 is executed by the third detection processing portion 51 of the control portion 5.

The control portion 5, for example, detects whether or not the toner container 316 is in the second state based on the remaining amount of toner in the developing portion 313 detected by the toner sensor 313N. For example, the control portion 5 detects whether or not the toner container 316 is in the second state based on an increase rate of the remaining amount of toner in the developing portion 313 detected by the toner sensor 313N when the toner is supplied from the toner container 316 to the developing portion 313 during the print process.

Here, upon detecting that a toner container is in the second state (Yes side at S11), the control portion 5 rewrites a piece of state information corresponding to the toner container detected to be in the second state, so as to indicate the second state, whereas up to that point, the piece of state information has indicated the third state. The control portion 5 then moves the process to step S12. On the other hand, upon detecting that no toner container is in the second state (No side at S11), the control portion 5 moves the process to step S13.

<Step S12>

In step S12, the control portion 5 notifies about the toner container that was detected to be in the second state in step S11. Here, the process of step S12 is executed by the notification processing portion 52 of the control portion 5.

For example, upon detecting in step S11 that the toner container 316 is in the second state, the control portion 5 displays, on the operation/display portion 1, a message that the toner container 316 is in the second state. This allows the user to recognize that the remaining amount of toner in the toner container 316 has decreased, and prepare a new toner container 316 before the toner container 316 runs out of toner.

<Step S13>

In step S13, the control portion 5 detects whether or not any of the image forming units has an abnormality in a case where a print process is being executed. Here, the process of step S13 is an example of the third step of the present disclosure, and executed by the second detection processing portion 55 of the control portion 5.

Here, upon detecting that an image forming unit has an abnormality (Yes side at S13), the control portion 5 moves the process to step S14. On the other hand, upon determining that no image forming unit has an abnormality (No side at S13), the control portion 5 moves the process to step S15.

<Step S14>

In step S14, the control portion 5 executes the second regulation control process that is described below.

<Step S15>

In step S15, the control portion 5 determines whether or not any of the toner containers attached to the attachment portions 317, 327, 337, and 347 is in the first state, wherein in the first state, the remaining amount of toner in the toner container is smaller than the first reference amount. Here, the process of step S15 is an example of the first step of the present disclosure, and executed by the first detection processing portion 53 of the control portion 5.

For example, as is the case with step S11, the control portion 5 determines whether or not the toner container 316 is in the first state based on the remaining amount of toner in the developing portion 313 detected by the toner sensor 313N. For example, the control portion 5 detects whether or not the toner container 316 is in the first state based on the increase rate of the remaining amount of toner in the developing portion 313 detected by the toner sensor 313N when the toner is supplied from the toner container 316 to the developing portion 313 during the print process.

Here, upon determining that a toner container is in the first state (Yes side at S15), the control portion 5 rewrites a piece of state information corresponding to the toner container detected to be in the first state, so as to indicate the first state, whereas up to that point, the piece of state information has indicated the second state. The control portion 5 then moves the process to step S16. On the other hand, upon determining that no toner container is in the first state (No side at S15), the control portion 5 moves the process to step S11 and waits for detection of any of the toner containers that is in the second state or the first state, or detection of an abnormality in any of the image forming units.

<Step S16>

In step S16, the control portion 5 executes the first regulation control process as described in the following.

[First Regulation Control Process]

Figure 7:
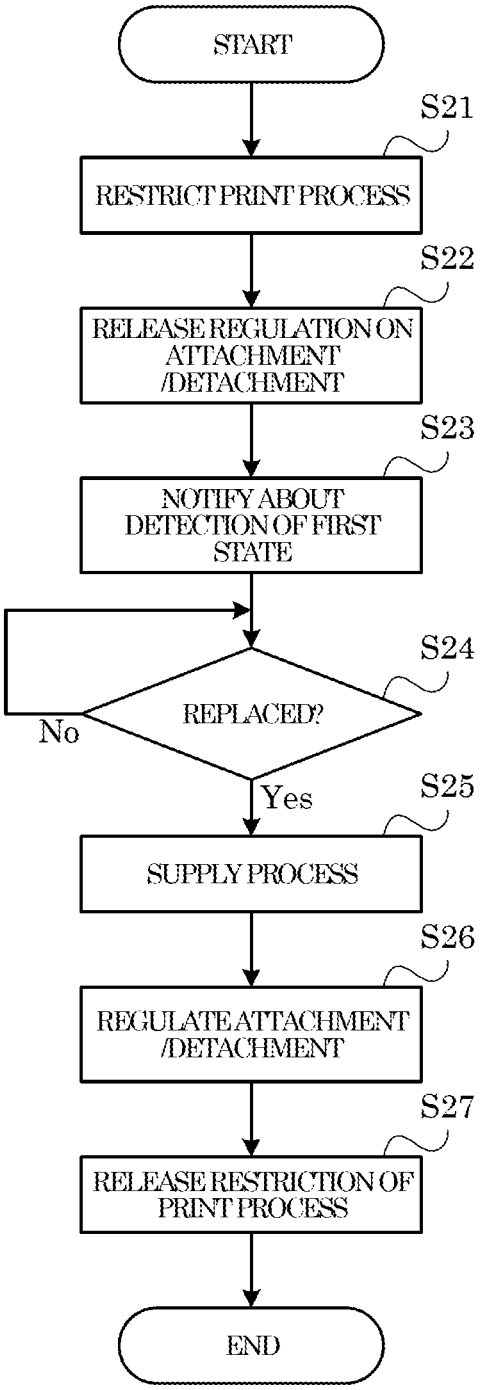
FIG. 7 is a flowchart showing an example of a first regulation control process executed by the image forming apparatus according to the embodiment of the present disclosure.

Next, in the following, with reference to FIG. 7, a description is given of an example of the procedure of the first regulation control process executed in step S16 of the abnormality detection process.

<Step S21>

First, in step S21, the control portion 5 restricts an execution of the print process by the image forming portion 3.

For example, in a case where the print process is being executed, the control portion 5 stops the print process. In addition, in a case where the print process is not being executed, the control portion 5 prohibits the execution of the print process. It is noted that in the case where the print process is being executed, the control portion 5 may stop the print process after outputting a predetermined number of sheets. This prevents the image forming apparatus 10 from outputting a print with low printing density.

<Step S22>

In step S22, the control portion 5 causes the lock mechanisms 318, 328, 338, and 348 to release the regulation on attachment/detachment of the toner container detected to be in the first state in step S15 of the abnormality detection process. Here, the process of step S22 is an example of the second step of the present disclosure, and executed by the first release processing portion 54 of the control portion 5.

For example, upon detecting, in step S15 of the abnormality detection process, that the toner container 316 is in the first state, the control portion 5 causes the power source portion to supply power to the locking piece moving portion 318B. With this execution, in the lock mechanism 318, the locking piece 318A is moved from the closing position to the opening position, and is held in the opening position. This allows for a replacement of the toner container 316.

<Step S23>

In step S23, the control portion 5 notifies about the toner container that was detected to be in the first state in step S15 of the abnormality detection process. Here, the process of step S23 is executed by the notification processing portion 52 of the control portion 5.

For example, upon determining in step S15 of the abnormality detection process that the toner container 316 is in the first state, the control portion 5 displays, on the operation/display portion 1, a message that the toner container 316 is in the first state. This allows the user to recognize that the toner container 316 has run out of toner, and perform a replacement of the toner container 316.

<Step S24>

In step S24, the control portion 5 determines whether or not the toner container whose regulation on attachment/detachment had been released in step S22 was replaced with a new one. For example, in a case where the open/close detection switch has detected opening and then closing of the housing cover 10A, the control portion 5 determines that the toner container whose regulation on attachment/detachment had been released was replaced with a new toner container.

Here, upon determining that the toner container whose regulation on attachment/detachment had been released was replaced with a new one (Yes side at S24), the control portion 5 moves the process to step S25. On the other hand, upon determining that the toner container whose regulation on attachment/detachment had been released has not been replaced with a new one (No side at S24), the control portion 5 waits at step S24 for the toner container whose regulation on attachment/detachment has been released to be replaced with a new one.

<Step S25>

In step S25, with regard to each toner container that was determined in step S24 to have been replaced with a new one, the control portion 5 executes the supply process of causing the toner container to supply toner to the developing portion until the remaining amount of toner in the developing portion detected by the toner sensor exceeds the threshold. Here, the process of step S25 is executed by the supply processing portion 57 of the control portion 5.

For example, upon determining in step S24 that the toner container 316 has been replaced with a new one, the control portion 5 executes the supply process of causing the toner container 316 to supply toner to the developing portion 313 until the remaining amount of toner in the developing portion 313 detected by the toner sensor 313N exceeds the threshold. Specifically, the control portion 5 controls the second drive portion 317B to drive the conveyance member of the toner container 316.

When the supply process for a toner container has been completed, the control portion 5 rewrites a piece of state information corresponding to the toner container for which the supply process has been completed, so as to indicate the third state, whereas up to that point, the piece of state information has indicated the first state. When the supply process is completed with regard to each toner container that was determined in step S24 to have been replaced with a new one, the control portion 5 moves the process to step S26.

<Step S26>

In step S26, the control portion 5 causes the lock mechanisms 318, 328, 338, and 348 to regulate the attachment/detachment of each toner container on which the supply process was executed in step S25. Here, the process of step S26 is executed by the regulation processing portion 58 of the control portion 5.

For example, in a case where the supply process was executed on the toner container 316 in step S25, the control portion 5 causes the power source portion to stop supplying power to the locking piece moving portion 318B. With this execution, in the lock mechanism 318, the locking piece 318A is moved from the opening position to the closing position, and is held at the closing position. This prohibits the toner container 316 from being replaced with a new one.

<Step S27>

In step S27, the control portion 5 releases the restriction of execution of the print process that was made in step S21. For example, in a case where the control portion 5 has stopped the print process in step S21, the control portion 5 resumes the execution of the print process. In addition, in a case where the control portion 5 has prohibited the execution of the print process in step S21, the control portion 5 releases the prohibition of execution of the print process.

[Second Regulation Control Process]

Figure 8:
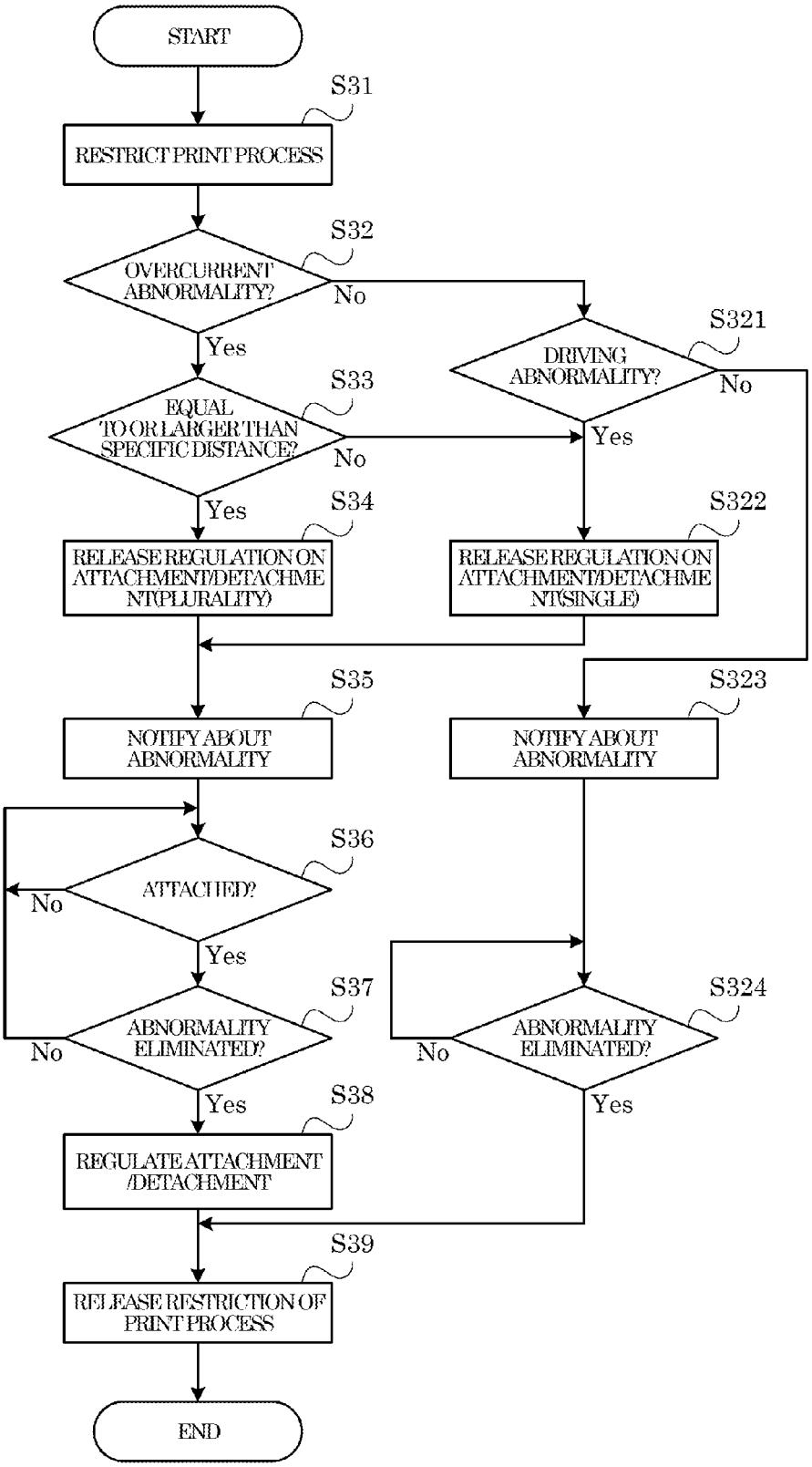
FIG. 8 is a flowchart showing an example of a second regulation control process executed by the image forming apparatus according to the embodiment of the present disclosure.

Next, in the following, with reference to FIG. 8, a description is given of an example of the procedure of the second regulation control process executed in step S14 of the abnormality detection process.

<Step S31>

First, in step S31, the control portion 5 restricts an execution of the print process. Specifically, the control portion 5 stops the print process that is being executed.

<Step S32>

In step S32, the control portion 5 determines whether or not the abnormality detected in step S13 of the abnormality detection process is the overcurrent abnormality.

Here, upon determining that the detected abnormality is the overcurrent abnormality (Yes side at S32), the control portion 5 moves the process to step S33. On the other hand, upon determining that the detected abnormality is not the overcurrent abnormality (No side at S32), the control portion 5 moves the process to step S321.

It is noted that the process of step S32 may be omitted. In that case, the control portion 5 may execute the process of step S34 after executing the process of step S31. In addition, in step S32, the control portion 5 may determine whether or not an abnormality other than the overcurrent abnormality was detected.

<Step S33>

In step S33, the control portion 5 determines whether or not the length in the conveyance direction D4 of the sheet conveyed by the sheet conveying portion 26 during the print process that was stopped in step S31, is equal to or larger than the specific distance.

Here, upon determining that the length in the conveyance direction D4 of the sheet conveyed by the sheet conveying portion 26 during the print process is equal to or larger than the specific distance (Yes side at S33), the control portion 5 moves the process to step S34. On the other hand, upon determining that the length in the conveyance direction D4 of the sheet conveyed by the sheet conveying portion 26 during the print process is smaller than the specific distance (No side at S33), the control portion 5 moves the process to step S322.

It is noted that the process of step S33 may be omitted. In that case, the control portion 5 may execute the process of step S34 upon determining in step S32 that the abnormality detected in step S13 of the abnormality detection process is the overcurrent abnormality.

<Step S34>

In step S34, the control portion 5 releases the regulation by the lock mechanisms on attachment/detachment of the plurality of toner containers corresponding to the plurality of image forming units that include at least an image forming unit(s) adjacent to the image forming unit that was detected to have the abnormality in step S13 of the abnormality detection process. Here, the process of step S34 is an example of the fourth step of the present disclosure, and executed by the second release processing portion 56 of the control portion 5.

For example, in a case where the control portion 5 has detected an overcurrent abnormality in the image forming unit 31 in step S13 of the abnormality detection process, the control portion 5 releases the regulation by the lock mechanism 318 on attachment/detachment of the toner container 316, and releases the regulation by the lock mechanism 328 on attachment/detachment of the toner container 326 that corresponds to the image forming unit 32 adjacent to the image forming unit 31.

In addition, in a case where the control portion 5 has detected an overcurrent abnormality in the image forming unit 32 in step S13 of the abnormality detection process, the control portion 5 releases the regulation by the lock mechanism 328 on attachment/detachment of the toner container 326, and releases the regulation by the lock mechanisms 318 and 338 on attachment/detachment of the toner containers 316 and 336 corresponding to the image forming units 31 and 33 adjacent to the image forming unit 32.

With the above-described configuration, even in a case where a paper jam has occurred and an overcurrent abnormality is detected, and a sheet that has caused the paper jam is in contact with a plurality of image forming units, it is possible to remove the sheet that has caused the paper jam.

<Step S321>

On the other hand, in a case where the control portion 5 has determined in step S32 that the abnormality detected in step S13 of the abnormality detection process is not the overcurrent abnormality, the control portion 5 executes the process of step S321. In step S321, the control portion 5 determines whether or not the abnormality detected in step S13 of the abnormality detection process is the driving abnormality.

Here, upon determining that the detected abnormality is the driving abnormality (Yes side at S321), the control portion 5 moves the process to step S322. On the other hand, upon determining that the detected abnormality is not the driving abnormality (No side at S321), the control portion 5 moves the process to step S323.

<Step S322>

In step S322, the control portion 5 releases the regulation by the lock mechanism on attachment/detachment of the toner container corresponding to the image forming unit that was detected to have the overcurrent abnormality or the driving abnormality in step S13 of the abnormality detection process. This prevents releasing of the regulation on attachment/detachment of a toner container that is irrelevant to the removal of the sheet that caused the paper jam. In addition, this prevents releasing of the regulation on attachment/detachment of a toner container that is irrelevant to the detected abnormality. Here, the process of step S322 is executed by the second release processing portion 56 of the control portion 5.

<Step S35>

In step S35, the control portion 5 notifies about the abnormality detected in step S13 of the abnormality detection process, and notifies about the toner container whose regulation on attachment/detachment was released in step S34 or S322. Here, the process of step S35 is executed by the notification processing portion 52 of the control portion 5.

For example, in a case where the overcurrent abnormality in the toner container 316 was detected in step S13 of the abnormality detection process, the control portion 5 displays, on the operation/display portion 1, a message indicating that the overcurrent abnormality in the toner container 316 was detected and that the toner containers 316 and 326 can be removed. This enables the user to recognize the type of the abnormality that has occurred in the image forming apparatus 10, and perform the work of removing the sheet that caused the paper jam, recognizing that the toner containers 316 and 326 can be removed.

It is noted that in step S35, the control portion 5 may notify about only the abnormality detected in step S13 of the abnormality detection process.

<Step S36>

In step S36, the control portion 5 determines whether or not the toner container whose regulation on attachment/detachment had been released in step S34 or S322 has been attached. For example, in a case where the open/close detection switch has detected opening and then closing of the housing cover 10A, the control portion 5 determines that the toner container whose regulation on attachment/detachment had been released has been attached.

Here, upon determining that the toner container whose regulation on attachment/detachment had been released has been attached (Yes side at S36), the control portion 5 moves the process to step S37. On the other hand, upon determining that the toner container whose regulation on attachment/detachment had been released has not been attached (No side at S36), the control portion 5 waits at step S36 for attachment of a toner container whose regulation on attachment/detachment has been released.

<Step S37>

In step S37, the control portion 5 determines whether or not the overcurrent abnormality or the driving abnormality detected in step S13 of the abnormality detection process has been eliminated.

Here, upon determining that the overcurrent abnormality or the driving abnormality has been eliminated (Yes side at S37), the control portion 5 moves the process to step S38. On the other hand, upon determining that the overcurrent abnormality or the driving abnormality has not been eliminated (No side at S37), the control portion 5 moves the process to step S36.

<Step S38>

In step S38, the control portion 5 causes the lock mechanisms 318, 328, 338, and 348 to regulate the attachment/detachment of the toner container whose regulation on attachment/detachment was released in step S34 or S322. Here, the process of step S38 is executed by the regulation processing portion 58 of the control portion 5.

<Step S39>

In step S39, the control portion 5 releases the restriction of execution of the print process that was made in step S31. Specifically, the control portion 5 resumes the execution of the print process that was stopped in step S31.

<Step S323>

On the other hand, in a case where the control portion 5 has determined in step S321 that the abnormality detected in step S13 of the abnormality detection process is not the driving abnormality, the control portion 5 executes the process of step S323. In step S323, the control portion 5 notifies about the abnormality detected in step S13 of the abnormality detection process. Here, the process of step S323 is executed by the notification processing portion 52 of the control portion 5.

As described above, in the second regulation control process, in a case where an abnormality detected in step S13 of the abnormality detection process is neither the overcurrent abnormality nor the driving abnormality, the regulation on attachment/detachment of the toner container is not released. This prevents releasing of the regulation by the lock mechanism on attachment/detachment of a toner container even when it is not necessary to remove a toner container or an image forming unit, such as when the access abnormality is detected.

<Step S324>

In step S324, the control portion 5 determines whether or not the abnormality detected in step S13 of the abnormality detection process has been eliminated.

Here, upon determining that the detected abnormality has been eliminated (Yes side at S324), the control portion 5 moves the process to step S39. On the other hand, upon determining that the detected abnormality has not been eliminated (No side at S324), the control portion 5 waits at step S324 for the abnormality to be eliminated.

As described above, in the image forming apparatus 10, when any of the image forming units has been detected to have an overcurrent abnormality, a regulation is released, the regulation having been made by the lock mechanisms on attachment/detachment of two or more toner containers corresponding to two or more image forming units that include at least an image forming unit(s) adjacent to the image forming unit detected to have the overcurrent abnormality. This makes it possible to reduce the remaining amount of toner in the toner containers 316, 326, 336, and 346 at the time of replacement, and remove a sheet that has caused a paper jam in the apparatus.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a sheet conveying portion configured to convey a sheet;

a plurality of image forming units arranged in alignment along a conveyance direction in which the sheet is conveyed by the sheet conveying portion, the image forming units being configured to form an image by using developer on the sheet conveyed by the sheet conveying portion;

a plurality of attachment portions which are provided in correspondence with the plurality of image forming units and to which a plurality of developer storage portions are attached, the developer storage portions storing the developer to be supplied to the image forming units;

a plurality of lock mechanisms configured to regulate attachment and detachment of the developer storage portions attached to the attachment portions;

a first detection processing portion configured to detect, for each of the developer storage portions attached to the attachment portions, whether or not that developer storage portion is in a specific state in which a remaining amount of developer is smaller than a predetermined reference amount;

a first release processing portion configured to, when the first detection processing portion has detected that a developer storage portion is in the specific state, cause the lock mechanisms to release a regulation on attachment and detachment of the developer storage portion detected to be in the specific state;

a second detection processing portion configured to detect whether or not any of the image forming units has an abnormality; and a second release processing portion capable of, when the second detection processing portion has detected that an image forming unit has an abnormality, releasing a regulation by the lock mechanisms on attachment and detachment of two or more developer storage portions corresponding to two or more image forming units that include at least an image forming unit adjacent to the image forming unit detected to have the abnormality.

2. The image forming apparatus according to claim 1, further comprising:

a plurality of drive portions provided in correspondence with the plurality of image forming units and configured to supply a driving force to either or both of the image forming units and the developer storage portions attached to the attachment portions, wherein in a case where the abnormality detected by the second detection processing portion is an overcurrent abnormality in which a current supplied to the drive portion exceeds a predetermined allowable value, the second release processing portion releases the regulation by the lock mechanisms on attachment and detachment of the two or more developer storage portions corresponding to the two or more image forming units that include at least an image forming unit adjacent to the image forming unit detected to have the overcurrent abnormality.

3. The image forming apparatus according to claim 2, wherein in a case where the abnormality detected by the second detection processing portion is other than the overcurrent abnormality, the second release processing portion does not release a regulation by the lock mechanisms on attachment and detachment of developer storage portions corresponding to image forming units other than the image forming unit detected to have the abnormality.

4. The image forming apparatus according to claim 1, wherein the plurality of image forming units are arranged in alignment at regular intervals along the conveyance direction, and in a case where a length in the conveyance direction of the sheet conveyed by the sheet conveying portion is smaller than a predetermined specific distance that is equal to or larger than an interval between the plurality of image forming units, the second release processing portion does not release a regulation by the lock mechanisms on attachment and detachment of developer storage portions corresponding to image forming units other than the image forming unit detected to have the abnormality.

5. The image forming apparatus according to claim 1, further comprising:

a notification processing portion configured to, when a regulation by a lock mechanism has been released on attachment and detachment of a developer storage portion corresponding to an image forming unit other than the image forming unit detected to have the abnormality, notify about the developer storage portion whose regulation on attachment and detachment has been released.

6. The image forming apparatus according to claim 1, further comprising:

a regulation processing portion configured to, when it is determined that the abnormality detected by the second detection processing portion has been eliminated, causes the lock mechanisms to regulate attachment and detachment of developer storage portions whose regulation on attachment and detachment has been released by the second release processing portion.

7. A method for releasing a regulation on attachment and detachment of developer storage portions, the method being implemented in an image forming apparatus that includes: a sheet conveying portion configured to convey a sheet; a plurality of image forming units arranged in alignment along a conveyance direction in which the sheet is conveyed by the sheet conveying portion, the image forming units being configured to form an image by using developer on the sheet conveyed by the sheet conveying portion; a plurality of attachment portions which are provided in correspondence with the plurality of image forming units and to which a plurality of developer storage portions are attached, the developer storage portions storing the developer to be supplied to the image forming units; and a plurality of lock mechanisms configured to regulate attachment and detachment of the developer storage portions attached to the attachment portions, the method comprising:

a first step of detecting whether or not any of the developer storage portions attached to the attachment portions is in a specific state in which a remaining amount of developer in a developer storage portion is smaller than a predetermined reference amount;

a second step of, when the first step has detected that a developer storage portion is in the specific state, causing the lock mechanisms to release a regulation on attachment and detachment of the developer storage portion detected to be in the specific state;

a third step of detecting whether or not any of the image forming units has an abnormality; and a fourth step of being capable of, when the third step has detected that an image forming unit has an abnormality, releasing a regulation by the lock mechanisms on attachment and detachment of two or more developer storage portions corresponding to two or more image forming units that include at least an image forming unit adjacent to the image forming unit detected to have the abnormality.

* * * * *